US006534734B2

(12) United States Patent
Davis

(10) Patent No.: US 6,534,734 B2
(45) Date of Patent: Mar. 18, 2003

(54) DECORATIVE WALL PLATE SWITCH MECHANISM FOR OPERATING A TOGGLE SWITCH

(76) Inventor: Ralph K. Davis, 4205 Mowry Ave. #51, Fremont, CA (US) 94538

( * ) Notice: Subject to any disclaimer, the term of this patent is extended or adjusted under 35 U.S.C. 154(b) by 0 days.

(21) Appl. No.: 09/815,172

(22) Filed: Mar. 21, 2001

(65) Prior Publication Data

US 2002/0134655 A1 Sep. 26, 2002

(51) Int. Cl.[7] ..... H01H 3/20; H01H 17/00
(52) U.S. Cl. ..... 200/331
(58) Field of Search ..... 200/329–331, 200/339, 33 B; 174/66

(56) References Cited

U.S. PATENT DOCUMENTS 3,816,686 A * 6/1974 Budd et al. ..... 200/330
4,760,227 A * 7/1988 Boxer ..... 200/330
5,577,602 A * 11/1996 Conner et al. ..... 200/331
5,806,665 A * 9/1998 Houssian ..... 200/330

* cited by examiner

*Primary Examiner*—J. R. Scott
(74) *Attorney, Agent, or Firm*—Gene Scott-Patent Law & Venture Group

(57) ABSTRACT

An electric switch requiring mechanical movement for actuation is mounted to a surface mountable switch mounting plate by standoffs so as to position a toggle bat in position for actuation by a planar switch cover plate adapted for sliding engagement, in parallel juxtaposition, with the switch mounting plate. The switch cover plate is adapted for engagement with the electric switch for actuation thereof by sliding engagement.

5 Claims, 2 Drawing Sheets

DECORATIVE WALL PLATE SWITCH MECHANISM FOR OPERATING A TOGGLE SWITCH

BACKGROUND OF THE INVENTION

1. Field of the Invention

This invention relates generally to electrical switches and more particularly to a wall mounted light switch with a movable flat plate decorative cover.

2. Description of Related Art

Wall switches and their cover plates are available in a range of sizes, types and designs. Typically switches are mounted onto walls for easy access by those using electrically powered devices. Such mounting is achieved by running power lines to utility boxes mounted to wall structure adjacent to the wall surface. Such boxes are then available for receiving electric switches, typically of the toggle type, whereby the switches are mechanically mounted to the box and wired to the power lines. The switch and utility box with its wires, are then covered by a wall mounted cover plate. Such plates typically have a slot which receives a toggle bat from the switch so that the switch may be actuated manually. Many variations exist on this typical switch mounting approach. For instance, the switch may be of the dimmer type which is actuated by either rotation, push-pull or sliding action of a control protruding outwardly from the cover plate. A major drawback of the prior art approach is that the cover plate, which is continuously manually handled is subject to dirt and grime and is particularly difficult to clean since the switch control protrudes through the cover plate so that a simple wiping of the cover plate is not effective. Further, the outwardly protruding switch control is easily bumped and potentially broken when mounting in close quarters such as a narrow hallway or closet.

The prior art teaches the use of electric wall mounted controls but fails to teach a control that does not require a protruding control mechanism and that provides a planar outwardly unbroken surface that is easily cleaned by simple wiping. The present invention fulfills these needs and provides further related advantages as described in the following summary.

SUMMARY OF THE INVENTION

An electric switch requiring mechanical movement for actuation is mounted to a surface mountable switch mounting plate by standoffs so as to position a toggle bat in position for actuation by a planar switch cover plate adapted for sliding engagement, in parallel juxtaposition, with the switch mounting plate. The switch cover plate is adapted for engagement with the electric switch for actuation thereof by sliding engagement. The unbroken planar outwardly facing surface is easily wiped clean and does not provide an outwardly protruding control mechanism that might be easily bumped or broken. The exterior plate has no visible screws and may be painted or otherwise adapted to match or contrast with walls, and decorator items.

A primary objective of the present invention is to provide an apparatus and method of use of such apparatus that provides advantages not taught by the prior art.

Another objective is to provide such an invention capable of presenting a planar unbroken surface to the user.

A further objective is to provide such an invention capable of utilizing a standard electric switch.

A still further objective is to provide such an invention capable of simple and inexpensive construction by plastic molding processes.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
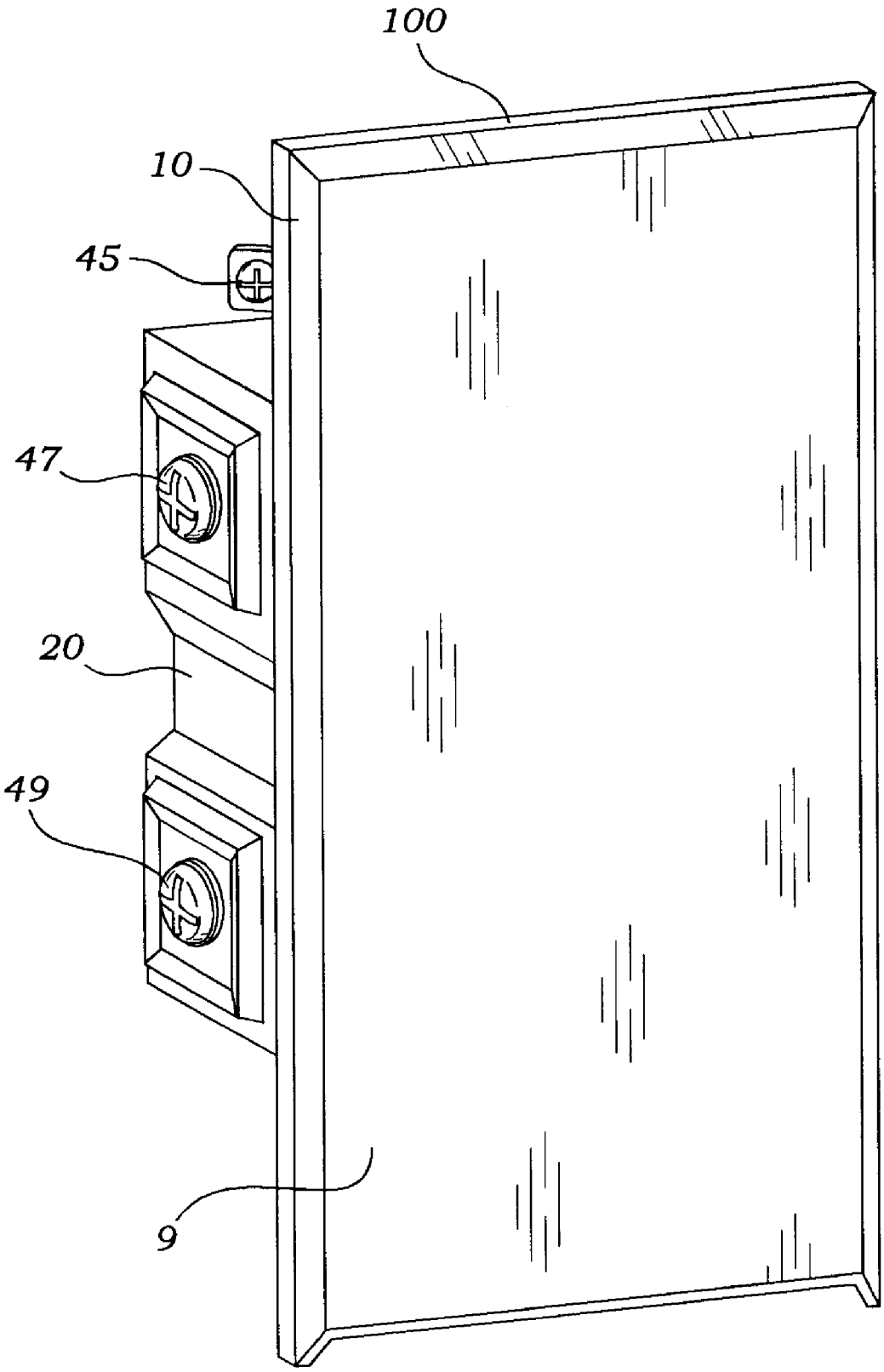
FIG. 1 is a perspective view of the present invention.

The above described drawing figures illustrate the invention in at least one of its preferred embodiments, which is further defined in detail in the following description.

A wall switch apparatus 100 comprising an electric switch 20 having a mechanical movement means 43 for actuation; a surface mountable switch mounting plate 12 (bezel plate); means for mounting 15, 19, 41 the electric switch 20 onto the switch mounting plate 12; a planar switch cover plate 10 with angular walls, and adapted for sliding engagement, in parallel juxtaposition, with the switch mounting plate 12, the switch cover plate 10 further adapted for engagement with the electric switch 20 for actuation thereof by said sliding engagement.

Preferably, the mechanical movement means 43 of the electric switch 20 is a toggle bat 43 adapted for actuation of the electric switch 20, the switch mounting plate 12 receiving a toggle actuator 21 in sliding engagement therewith, the toggle actuator 21 further engaging the toggle bat 43 of the electric switch 20 for actuation thereof. Preferably, electric switch 20 is mounted in spaced relationship with the switch mounting plate 12 so as to present the toggle bat 43 to the toggle actuator 21. Preferably, the planar switch cover plate 10 provides a flat unbroken surface 9 on one side surface thereof and a protruding actuation finger 22 on an opposing side surface thereof.

In FIG. 1 we see that assembly 100 consists of the low profile switch cover plate 10 with an unbroken and smooth exterior surface 9. It is attached to a standard utility electric switch 20 typically designed to serve electric lights and other household needs. Assembly 100 may be permanently affixed to a standard electrical junction box providing electric power wiring. An electrical load is wired in series with electrical contacts 47 and 49 of switch 20. A grounding wire is connected to electrical contact 45. The load is turned on by an upward vertical movement of cover plate 10, and turned off by a downward vertical movement of the plate.

Figure 2:
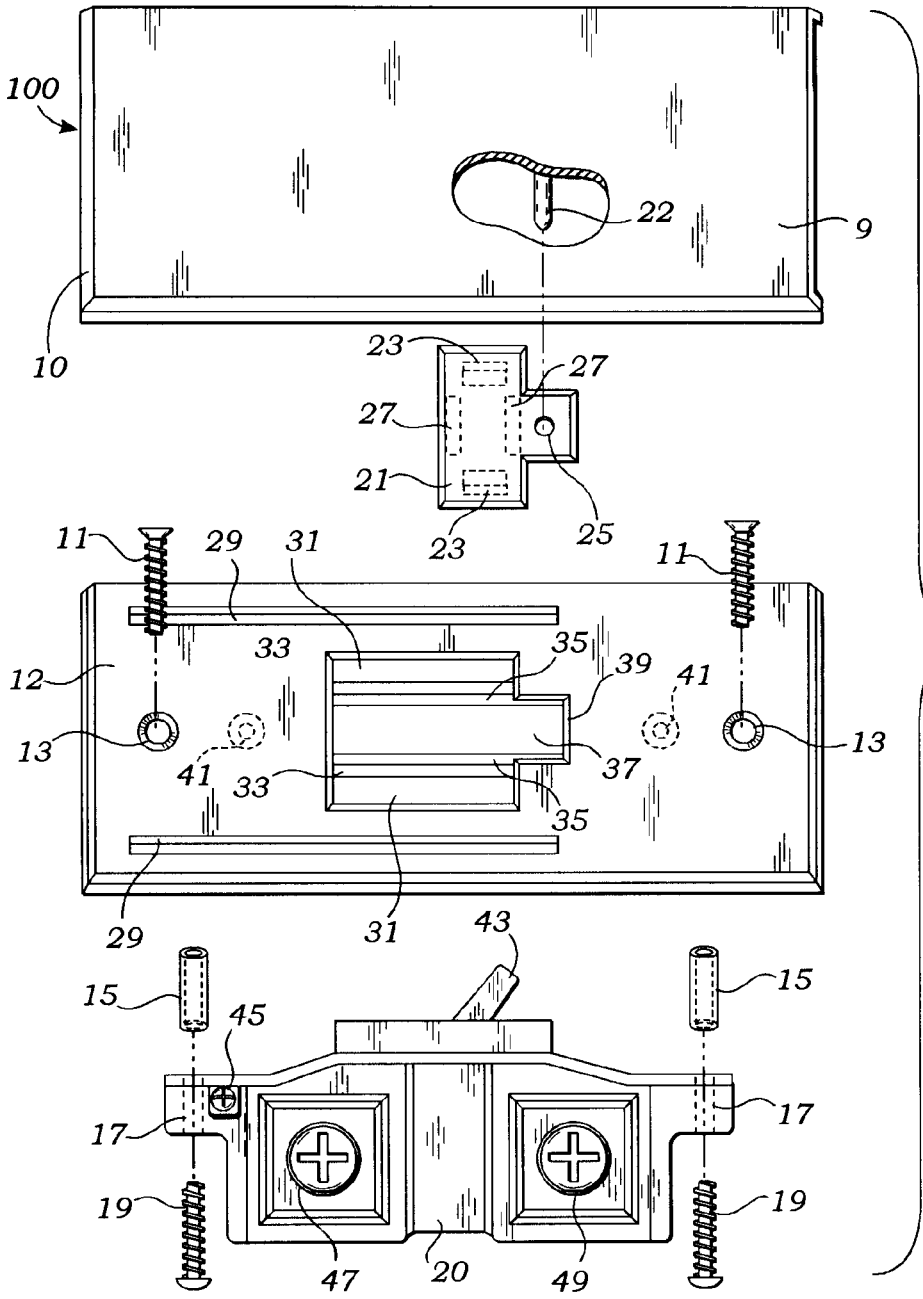
FIG. 2 is an exploded view thereof with a switch cover plate and mounting standoffs portions shown in perspective, a slider actuator and mounting plate portions shown in plan view and a toggle switch and mounting hardware portions shown in side elevational view.
Figure 3:
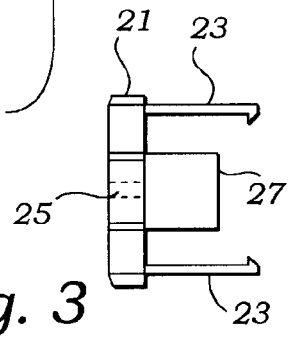
FIG. 3 is a side elevational view of the slider actuator thereof.

FIG. 2 is an exploded view of the several components of the invention. Electric switch 20 is permanently attached to bezel plate 12 by matched screws 19 extending through holes 17 and tubular bosses 15. These bosses are permanently affixed to the bottom side of bezel plate 12 into cavities 41 by an adhesive or solvent bonding process as is well known in the art. The tubular bosses may also be formed as an integral part of bezel plate 12 in an injection molding process. The bezel plate 12, typically, is permanently attached to a standard electrical junction box (not shown) by matched screws 11 extending through countersunk holes 13. Sliding actuator 21 is affixed to bezel plate 12 by its placement in cavity 39, thus placing the downwardly extending mounting legs 23 through mounting slots 33 in bezel plate 12, i.e., outwardly spaced apart adjacent to ribs 35. The formed terminal ends of legs 23 create a snap action fit with ribs 35. This fit permits toggle actuator 21 to affix itself permanently to bezel plate 12 and to slide along the length of cavity 39 in bezel plate 12. Cover plate 10 is affixed to toggle actuator 21 by the mating of actuation finger 22 on the alternate side of plate 10 through hole 25 provided in toggle actuator 21. The engagement of these two parts form an interference fit. The interference fit permits the cover plate 10 to be disassembled and reassembled to the toggle actuator at will. This proven fastening method of mating similar or dissimilar parts to one another is used to mate the moveable plate 10 to toggle actuator 21. Electric switch 20 is positioned so that when moveable cover plate 10 is mated to toggle actuator 21, the downwardly extending tabs 27', 27" are positioned adjacent to toggle actuator 43. As cover plate 10 is moved in one direction, tab 27' engages actuator 43 moving it to the "on" position. As cover plate 10 is moved in an opposite direction, tab 27" engages the actuator 43 to move it to the "off" position. This novel apparatus utilizing a low profile planar cover plate 10 with an unbroken flat and smooth surface 9 to actuate an electric switch 20 is esthetically pleasing, adaptable to match or contrast with walls, and is modern and highly practical in that the cover plate surface 9 is easily cleaned.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus comprising: an electric switch providing mechanical movement means for actuation; a surface mountable switch mounting plate; means for mounting the electric switch onto the switch mounting plate; a planar switch cover plate fully covering the switch mounting plate with a planar, unbroken outer surface, the cover plate adapted with a rearwardly protruding actuation finger in sliding engagement with the switch mounting plate by engagement with a toggle actuator, thereby enabling electric switch actuation.

2. The apparatus of claim 1 wherein the mechanical movement means of the electric switch is a toggle bat adapted for actuation of the electric switch, the switch mounting plate receiving a toggle actuator in sliding engagement therewith, the toggle actuator further engaging the toggle bat of the electric switch for actuation thereof.

3. The apparatus of claim 2 wherein the toggle actuator provides mounting legs extending therefrom and adapted for snap action and sliding engagement with mounting slots of the mounting plate.

4. The apparatus of claim 2 wherein the electric switch is mounted in spaced relationship with the switch mounting plate so as to present the toggle bat to the toggle actuator.

5. The apparatus of claim 1 wherein the planar switch cover plate provides the flat unbroken outer surface on one side surface thereof and a protruding actuation finger on an opposing side surface thereof.

* * * * *